US011713697B2

(12) United States Patent
Frey

(10) Patent No.: US 11,713,697 B2
(45) **Date of Patent: *Aug. 1, 2023**

(54) ENERGY-RECOVERY TURBINES FOR GAS STREAMS

(71) Applicant: UOP LLC, Des Plaines, IL (US)

(72) Inventor: Stanley Joseph Frey, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/124,016

(22) Filed: Dec. 16, 2020

(65) Prior Publication Data

US 2021/0102476 A1 Apr. 8, 2021

Related U.S. Application Data

(63) Continuation of application No. 15/923,936, filed on Mar. 16, 2018, now Pat. No. 10,871,085.

(51) Int. Cl.

| | |
|---|---|
| ***F01K 13/02*** | (2006.01) |
| ***F01K 13/00*** | (2006.01) |
| ***F01K 25/14*** | (2006.01) |
| ***C10G 11/18*** | (2006.01) |
| ***C10G 47/36*** | (2006.01) |
| ***C10G 45/72*** | (2006.01) |

(52) U.S. Cl.

CPC ..... *F01K 13/02* (2013.01); *C10G 11/18* (2013.01); *C10G 45/72* (2013.01); *C10G 47/36* (2013.01); *F01K 13/006* (2013.01); *F01K 25/14* (2013.01)

(58) Field of Classification Search

CPC ..... C10G 11/18; C10G 45/72; C10G 47/36; F01K 13/02; F01K 13/006; F01K 25/14; F01D 17/16; F01D 17/162

See application file for complete search history.

(56) References Cited

U.S. PATENT DOCUMENTS

| | | | |
|---|---|---|---|
| 4,285,481 | A | 8/1981 | Biscomb |
| 4,455,614 | A | 6/1984 | Martz et al. |
| 5,384,489 | A | 1/1995 | Bellac |
| 5,481,145 | A | 1/1996 | Canders et al. |
| 6,265,453 | B1 | 7/2001 | Kennedy |

(Continued)

FOREIGN PATENT DOCUMENTS

| | | | |
|---|---|---|---|
| CN | 102203780 | A | 9/2011 |
| CN | 103917280 | A | 7/2014 |

(Continued)

OTHER PUBLICATIONS

International Search Report from corresponding PCT application No. PCT/US2019/022420, dated Jun. 20, 2019.

(Continued)

*Primary Examiner* — Mark A Laurenzi
*Assistant Examiner* — Xiaoting Hu

(57) ABSTRACT

Processes for controlling the flowrate of and recovering energy from a gas stream in a processing unit are described. One process comprises directing a portion of the gas stream through one or more variable-resistance power-recovery turbines to control the flowrate of the gas stream and generate electric power therefrom; and controlling the pressure and temperature of the gas stream so that the gas exiting the power-recovery turbine remains in the gas phase.

19 Claims, 3 Drawing Sheets

(56) References Cited

U.S. PATENT DOCUMENTS

| | | | | |
|---|---|---|---|---|
| 6,354,084 | B1 | 3/2002 | McKinley et al. | |
| 6,681,155 | B1 | 1/2004 | Fujita et al. | |
| 6,898,540 | B2 * | 5/2005 | Davies | G05B 23/0221 702/105 |
| 7,062,359 | B2 | 6/2006 | Bjorklund | |
| 7,757,493 | B2 | 7/2010 | Bell et al. | |
| 7,948,101 | B2 | 5/2011 | Burtch | |
| 8,404,918 | B2 | 3/2013 | Frey | |
| 8,510,015 | B2 | 8/2013 | Beausoleil et al. | |
| 8,680,704 | B1 | 3/2014 | Rooney | |
| 8,763,625 | B1 | 7/2014 | Carter | |
| 8,967,590 | B2 | 3/2015 | Minervini et al. | |
| 9,085,499 | B2 | 7/2015 | Frey et al. | |
| 9,235,228 | B2 | 1/2016 | Gazit et al. | |
| 9,677,015 | B2 | 6/2017 | Gupta et al. | |
| 9,752,460 | B2 | 9/2017 | Bowan | |
| 9,764,272 | B2 | 9/2017 | Martin et al. | |
| 10,246,645 | B2 | 4/2019 | Froehle et al. | |
| 10,260,415 | B2 | 4/2019 | Simpkin et al. | |
| 10,508,568 | B2 | 12/2019 | Frey | |
| 10,690,010 | B2 | 6/2020 | Harris | |
| 10,745,631 | B2 | 8/2020 | Frey | |
| 10,753,235 | B2 | 8/2020 | Harris | |
| 10,794,225 | B2 | 10/2020 | Frey | |
| 10,811,884 | B2 | 10/2020 | Frey | |
| 10,829,698 | B2 | 11/2020 | Frey | |
| 2005/0034463 | A1 | 2/2005 | Simpson et al. | |
| 2006/0056120 | A1 | 3/2006 | Kawamura et al. | |
| 2008/0015839 | A1 | 1/2008 | Noureldin et al. | |
| 2009/0125152 | A1 | 5/2009 | Skowronski et al. | |
| 2011/0077448 | A1 * | 3/2011 | Frey | C07C 7/11 585/826 |
| 2011/0100004 | A1 | 5/2011 | Al-Mazeedi | |
| 2011/0308252 | A1 * | 12/2011 | Kopecek | F22G 5/00 60/653 |
| 2012/0107227 | A1 | 5/2012 | Fischer et al. | |
| 2012/0118526 | A1 | 5/2012 | Sudau et al. | |
| 2012/0227440 | A1 | 9/2012 | Guidati et al. | |
| 2012/0245754 | A1 | 9/2012 | Mehnert | |
| 2012/0260667 | A1 | 10/2012 | Chillar et al. | |
| 2012/0326443 | A1 * | 12/2012 | Vince | F03B 15/00 290/7 |
| 2013/0019530 | A1 | 1/2013 | Favilli et al. | |
| 2013/0199185 | A1 | 8/2013 | Wain et al. | |
| 2014/0291201 | A1 * | 10/2014 | Banerjee | F22G 5/00 60/653 |
| 2014/0331672 | A1 | 11/2014 | Filippi et al. | |
| 2015/0118131 | A1 | 4/2015 | Martin et al. | |
| 2016/0079756 | A1 | 3/2016 | Ikeyama et al. | |
| 2016/0141878 | A1 | 5/2016 | Johansen | |
| 2016/0161536 | A1 | 6/2016 | Amminudin | |
| 2016/0252015 | A1 | 9/2016 | Kusumi et al. | |
| 2016/0319198 | A1 | 11/2016 | Quanci et al. | |
| 2017/0058206 | A1 | 3/2017 | Noureldin et al. | |
| 2017/0058207 | A1 | 3/2017 | Noureldin et al. | |
| 2017/0292350 | A1 | 10/2017 | Weflen | |
| 2019/0199128 | A1 | 6/2019 | Neufeld et al. | |

FOREIGN PATENT DOCUMENTS

| | | | |
|---|---|---|---|
| CN | 104463341 | A | 3/2015 |
| CN | 206538206 | | 10/2017 |
| EP | 0552039 | | 7/1993 |
| EP | 2778354 | A1 | 9/2014 |
| FR | 2414162 | | 8/1979 |
| RU | 2014114067 | | 10/2015 |
| WO | 2005041396 | A2 | 5/2005 |
| WO | 2007105976 | A1 | 9/2007 |
| WO | 2007053036 | A1 | 10/2007 |
| WO | 2012128928 | A1 | 9/2012 |
| WO | 2013148175 | A1 | 10/2013 |
| WO | 2014119569 | A1 | 8/2014 |
| WO | 2014178079 | A2 | 11/2014 |
| WO | 2015065949 | A1 | 5/2015 |
| WO | 2016177376 | A1 | 11/2016 |
| WO | 2018005184 | A1 | 1/2018 |

OTHER PUBLICATIONS

Mohammadzadeh, Ashkan, et al., Design of a wind turbine model for clean energy. Case study: Khorasan Razavi regional electricity company, Acta Technica, 62, No. 4B/2017-1-8.

Guitiérrez-Antonio, Claudia, et al, Intensification of the hydrotreating process to produce renewable aviation fuel through reactive distillation, Science Direct, vol. 124, Feb. 2018.

Written Opinion from corresponding PCT application No. PCT/US2019/02240, completed Jun. 13, 2019.

Tsourapas, Vasilios, Control Analysis of Integrated Fuel Cell Systems with Energy Recuperation Devices, 2007.

The Elliot Group, Maximize the Efficiency of your Steam Process, 2014.

U.S. Department of Energy, Replace Pressure-Reducing Valves with Backpressure Turbogenerators.

Mechanical Solutions, Inc., Replacing a Pressure Reducing Valve with a Hydro Turbine for a Municipal Water Supply, Jul. 19, 2016.

Frey, Stanley J., et al., U.S. Appl. No. 16/357,001, filed Mar. 18, 2019 and entitled "System for Consolidation and Use of Power Recovered from a Turbine in a Process Unit".

Frey, Stanley J., et al., U.S. Appl. No. 16/355,191, filed Mar. 15, 2019 and entitled "System for Power Recovery from Quench and Dilution Vapor Streams".

Frey, Stanley Joseph, et al., U.S. Appl. No. 15/923,997, filed Mar. 16, 2018 and entitled "Processes for Adjusting at Least One Process Condition of a Chemical Processing Unit with a Turbine".

Extended European Search Report for European application No. 19767513.5 dated Dec. 15, 2021.

* cited by examiner

ENERGY-RECOVERY TURBINES FOR GAS STREAMS

RELATED APPLICATIONS

This application is a continuation of U.S. Ser. No. 15/923,936 filed on Mar. 16, 2018, the entirety of which is incorporated herein by reference.

BACKGROUND OF THE INVENTION

Chemical processing units generally use conventional control valves to control the large liquid and gas streams. The pressure loss and consequent energy loss across the control valve is substantial. The pressure drop across the control valve at the least open position for a liquid stream with a flow rate of 2000 $m^3$/hr could be about 172 kPa (25 psi). This represents almost 100 kW of dissipated power. As a result, the pump must be oversized to account for the energy dissipation, and that energy is lost on a consistent basis. Moreover, a flow sensing element needs to be installed in the system which adds to the installation cost. Finally the control valve typically is sealed via a packing system, which allows for hydrocarbon fugitive emissions regulated by the EPA and other agencies.

Therefore, there is a need for an improved process for regulating gas streams with minimal emissions and energy loss.

DETAILED DESCRIPTION

Figure 1:
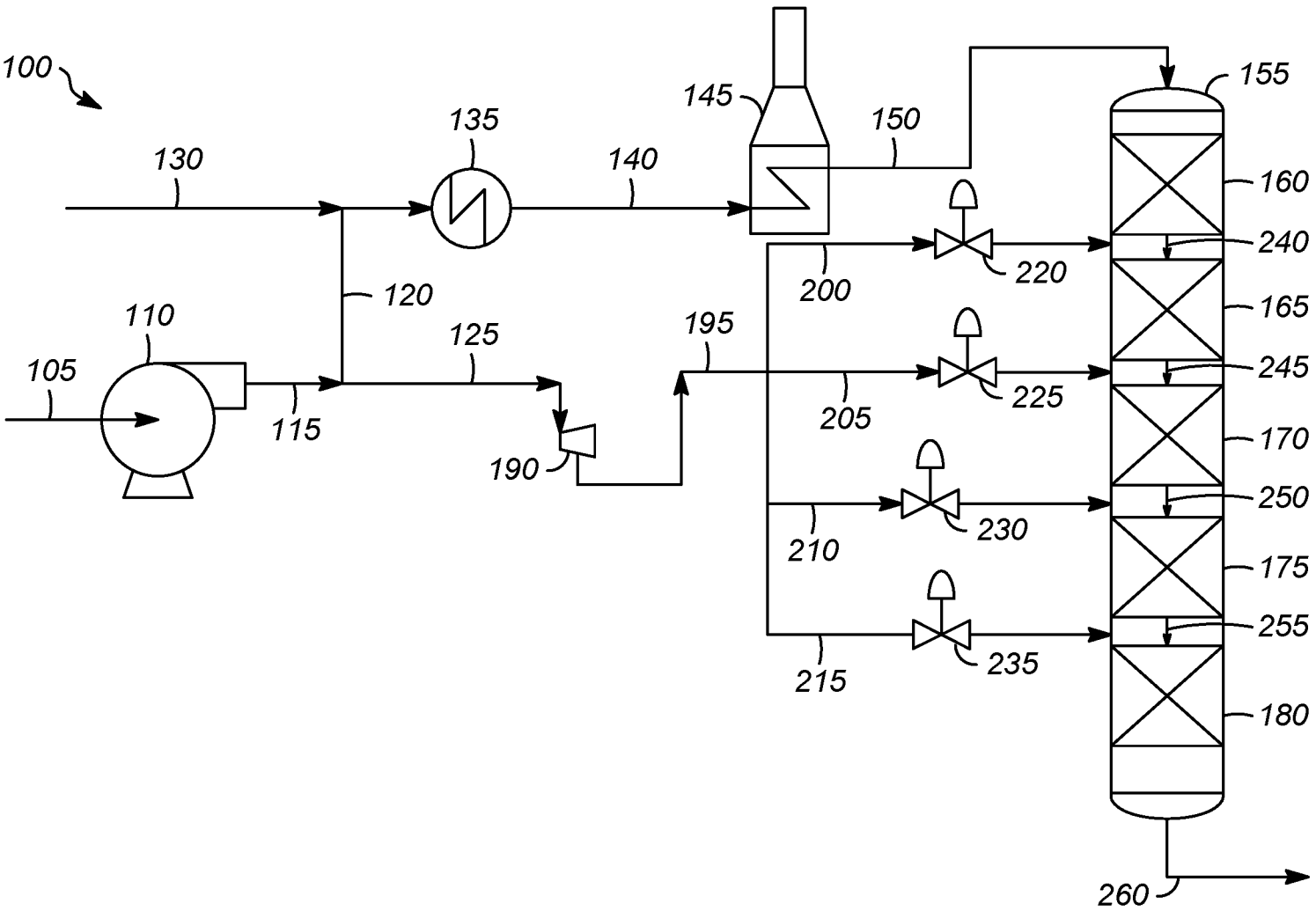
FIG. 1 is an illustration of one embodiment of the process of the present invention in a hydroprocessing unit.

The present invention uses a variable-resistance power-recovery turbine to regulate, measure, and recover energy from the controlled gas stream. The power-recovery turbine can be used as a flow control element both measuring and regulating a flow. The signal from the power-recovery turbine is electronic so no transducer is needed to convert between pressure and electrical signals. Most importantly, it provides the ability to recover electrical energy from the gas flow regulating function as opposed to simply dissipating the energy as in a control valve.

In some embodiments, the power-recovery turbine can replace the control valve, eliminating any flow of fugitive emissions from the active control valve packing gland. In some embodiments, it can also replace the flow measuring device, which is typically an orifice plate with pressure sensing taps. In this situation, a single piece of equipment is inserted into a gas stream conduit instead of two. Furthermore, there are no packing glands, pressure taps, transducers on process lines, or process impulse lines, which results in greatly reduced or altogether eliminated fugitive gas emissions and much higher intrinsic safety. This results in lower maintenance costs, lower fixed emissions, and a lower risk of gas release hazards.

Energy may be recovered, preferably in the form of power, by directing a portion of the gas stream through the variable-load power-recovery turbine.

The invention may be applied in one or more processing units comprising conversion processes such as, for example, at least one of an alkylation zone, a separation zone, an isomerization zone, a catalytic reforming zone, a fluid catalytic cracking zone, a hydrocracking zone, a hydrotreating zone, a hydrogenation zone, a dehydrogenation zone, an oligomerization zone, a desulfurization zone, an alcohol to olefins zone, an alcohol to gasoline zone, an extraction zone, a distillation zone, a sour water stripping zone, a liquid phase adsorption zone, a hydrogen sulfide reduction zone, a transalkylation zone, a coking zone, and a polymerization zone processes.

In some embodiments, the process for controlling a flowrate of and recovering energy from a process stream in a processing unit comprises directing a portion of the process stream through one or more variable-resistance power-recovery turbines to control the flowrate of the process stream using a variable nozzle turbine, inlet variable guide vanes, or direct coupled variable electric load, to name a few, to vary the resistance to flow through the turbine.

The resistance to rotation of the variable-resistance turbine can be varied by an external variable load electric circuit which is in a magnetic field from a magnet(s) that is rotating on the turbine. As more load is put on the circuit, there is more resistance to rotation on the turbine. This in turn imparts more pressure drop across the turbine and slows the process stream flow. An algorithm in the device can also calculate the actual flow through the device by measuring the turbine RPM's and the load on the circuit. The resistance to rotation can also be varied for variable position inlet guide vanes. In some embodiments, the power will be generated via power-recovery turbines with variable resistance to flow made possible by either guide vanes or variable load on the electrical power generation circuit. An algorithm to calculate actual flow using the guide vanes position, power output and RPM's can be used.

If slow control response of the turbine is an issue, then the use of the turbine is limited to slow responding or "loose" control point applications. A slow responding application is contemplated to have a response time to reach half way (i.e., 50% of a difference) between a new (or target) steady state condition (e.g., temperature, pressure, flow rate) from an original (or starting) steady state condition when the new (or target) condition differs from the original (or stating) condition of at least 10%, of at least one second, or even greater, for example, ten seconds, at least one minute, at least ten minutes, or an hour or more, for half of the change to completed.

One aspect of the invention involves a process for controlling the flowrate of and recovering energy from a gas stream in a processing unit. In one embodiment, the process comprises directing a portion of the gas stream through one or more variable-resistance power-recovery turbines to control the flowrate of the gas stream and generate electric power therefrom; and controlling the pressure and temperature of the gas stream so that the gas exiting the power-recovery turbine remains in the gas phase.

In some embodiments, the flowrate can be measured or controlled or both by varying one or more of the speed or shaft torque of the one or more power-recovery turbines.

In some embodiments, the flowrate varies by less than about 10%, or less than about 5%, or less than about 1%. Typically, the flowrate of the gas remains constant. In some processes, changing conditions of the process, for example, catalyst deactivation in a reactor, or fouling of process equipment, over time can cause a gradual change in the desired gas flow. Moreover, many controlled process variables are indirectly controlled by flow rates, such as temperatures, pressures, or levels causing the flows to vary on a regular basis to adjust for climatic, material, or equipment performance variation cycles.

In some embodiments, the power-recovery turbine replaces a control valve in the process. In other embodiments, the power-recovery turbine is used in conjunction with a control valve, and a second portion of the gas is directed through the control valve. In some embodiments, the portion of the gas directed through the power-recovery turbine is greater than the second portion of gas directed though the control valve.

In some embodiments, the process includes receiving information from a plurality of pressure reducing devices, the plurality of pressure reducing devices comprising the one or more power-recovery turbines, or a control valve, or both; determining a power loss value or a power generated value for each of the pressure reducing devices; determining a total power loss value or a total power generated value based upon the power loss values or the power generated values from each of the pressure reducing devices; and, displaying the total power loss value or the total power generated value on at least one display screen.

In some embodiments, the method includes adjusting at least one process parameter in the processing unit based upon the total power loss value or the total power generated value. In some embodiments, after the at least one process parameter has been adjusted, an updated power loss value or an updated power generated value is determined for each of the pressure reducing devices; an updated total power loss value or an updated total power generated value is determined for the processing unit based upon the updated power loss values or the updated power generated values from each of the pressure reducing devices; and, the updated total power loss value or the updated total power generated value is displayed on at least one display screen. In some embodiments, information associated with conditions outside of the processing unit is received, and the total power loss value or the total power generated value is determined based in part upon the information associated with conditions outside of the processing unit. In some embodiments, information associated with a throughput of the processing unit is received, and the total power loss value or the total power generated value is determined based in part upon the information associated with the throughput of the processing unit. In some embodiments, the throughput of the processing unit is maintained while adjusting the at least one process parameter of the portion of a processing unit based upon the total power loss value or the total power generated value.

In some embodiments, information on the temperature and pressure of the gas stream in the processing unit is received; and at least one process parameter in the processing unit is adjusted so that the gas remains in the gas phase through the power recovery turbine. In some embodiments, at least one of the temperature, pressure, and flowrate of the gas stream is displayed on at least one display stream.

In some embodiments, the process for controlling a flowrate of and recovering energy from a gas stream in a processing unit comprises directing a portion of the gas stream through one or more variable-resistance power-recovery turbines to control the flowrate of the gas stream and generate electric power therefrom; controlling a pressure and temperature of the gas stream so that the gas exiting the power-recovery turbine remains in the gas phase; and measuring the flowrate or controlling the flowrate or both by varying one or more of the speed or shaft torque of the one or more power-recovery turbines.

In some embodiments, the flowrate varies by less than about 10%, or less than about 5%, or less than about 1%. Typically, the flowrate of the gas remains constant. In some processes, catalyst deactivation over time can cause a gradual increase in variation of the gas flow.

In some embodiments, the power-recovery turbine replaces a control valve in the process. In other embodiments, the power-recovery turbine is used in conjunction with a control valve, and a second portion of the gas is directed through the control valve. In some embodiments, the portion of the gas directed through the power-recovery turbine is greater than the second portion of gas directed though the control valve.

In some embodiments, the process includes receiving information from a plurality of pressure reducing devices, the plurality of pressure reducing devices comprising the one or more power-recovery turbines, or a control valve, or both; determining a power loss value or a power generated value for each of the pressure reducing devices; determining a total power loss value or a total power generated value based upon the power loss values or the power generated values from each of the pressure reducing devices; and, displaying the total power loss value or the total power generated value on at least one display screen.

In some embodiments, the method includes adjusting at least one process parameter in the processing unit based upon the total power loss value or the total power generated value. In some embodiments, after the at least one process parameter has been adjusted, an updated power loss value or an updated power generated value is determined for each of the pressure reducing devices; an updated total power loss value or an updated total power generated value is determined for the processing unit based upon the updated power loss values or the updated power generated values from each of the pressure reducing devices; and, the updated total power loss value or the updated total power generated value is displayed on at least one display screen. In some embodiments, information associated with conditions outside of the processing unit is received, and the total power loss value or the total power generated value is determined based in part upon the information associated with conditions outside of the processing unit. In some embodiments, information associated with a throughput of the processing unit is received, and the total power loss value or the total power generated value is determined based in part upon the information associated with the throughput of the processing unit. In some embodiments, the throughput of the processing unit is maintained while adjusting the at least one process parameter of the portion of a processing unit based upon the total power loss value or the total power generated value.

In some embodiments, information on the temperature and pressure of the gas stream in the processing unit is received; and at least one process parameter in the processing unit is adjusted so that the gas remains in the gas phase through the power recovery turbine. In some embodiments, at least one of the temperature, pressure, and flowrate of the gas stream is displayed on at least one display stream.

In some embodiments, the process for controlling a flowrate of and recovering energy from a gas stream in a processing unit comprises directing a portion of the gas stream through one or more variable-resistance power-recovery turbines to control the flowrate of the gas stream and generate electric power therefrom; controlling a pressure and temperature of the gas stream so that the gas exiting the power-recovery turbine remains in the gas phase; receiving information from a plurality of pressure reducing devices, the plurality of pressure reducing devices comprising: one or more power-recovery turbines; a control valve; or, both; determining a power loss value or a power generated value for each of the pressure reducing devices; determining a total power loss value or a total power generated value based upon the power loss values or the power generated values from each of the pressure reducing devices; and displaying the total power loss value or the total power generated value on at least one display screen.

In some embodiments, the flowrate can be measured or controlled or both by varying one or more of the speed or shaft torque of the one or more power-recovery turbines.

In some embodiments, the flowrate varies by less than about 10%, or less than about 5%, or less than about 1%. Typically, the flowrate of the gas remains constant. In some processes, changing conditions of the process, for example, catalyst deactivation in a reactor, or fouling of process equipment, over time can cause a gradual change in the desired gas flow. Moreover, many controlled process variables are indirectly controlled by flow rates, such as temperatures, pressures, or levels causing the flows to vary on a regular basis to adjust for climatic, material, or equipment performance variation cycles.

In some embodiments, the power-recovery turbine replaces a control valve in the process. In other embodiments, the power-recovery turbine is used in conjunction with a control valve, and a second portion of the gas is directed through the control valve. In some embodiments, the portion of the gas directed through the power-recovery turbine is greater than the second portion of gas directed though the control valve.

In some embodiments, the method includes adjusting at least one process parameter in the processing unit based upon the total power loss value or the total power generated value. In some embodiments, after the at least one process parameter has been adjusted, an updated power loss value or an updated power generated value is determined for each of the pressure reducing devices; an updated total power loss value or an updated total power generated value is determined for the processing unit based upon the updated power loss values or the updated power generated values from each of the pressure reducing devices; and, the updated total power loss value or the updated total power generated value is displayed on at least one display screen. In some embodiments, information associated with conditions outside of the processing unit is received, and the total power loss value or the total power generated value is determined based in part upon the information associated with conditions outside of the processing unit. In some embodiments, information associated with a throughput of the processing unit is received, and the total power loss value or the total power generated value is determined based in part upon the information associated with the throughput of the processing unit. In some embodiments, the throughput of the processing unit is maintained while adjusting the at least one process parameter of the portion of a processing unit based upon the total power loss value or the total power generated value.

In some embodiments, information on the temperature and pressure of the gas stream in the processing unit is received; and at least one process parameter in the processing unit is adjusted so that the gas remains in the gas phase through the power recovery turbine. In some embodiments, at least one of the temperature, pressure, and flowrate of the gas stream is displayed on at least one display stream.

Although the following descriptions illustrate the use of the invention in several different hydroprocessing units, it is not limited to use in hydroprocessing processes. Those of skill in the art will readily recognize that it can be used in a wide variety of other processes.

FIG. 1 illustrates one embodiment of the process 100 in which a variable-resistance power recovery turbine is added to a line having a control valve on a hydrogen stream in a hydroprocessing unit. Hydrogen stream 105 is compressed in compressor 110. The compressed hydrogen stream 115 is split into two portions, first and second hydrogen streams 120 and 125. First hydrogen stream 120 is combined with the hydrocarbon feed stream 130 and sent through heat exchanger 135 to raise the temperature. The partially heated feed stream 140 is sent to fired heater 145 to raise the temperature of the heated feed stream 150 exiting the fired heater 145 to the desired inlet temperature for the hydroprocessing reaction zone 155.

Second hydrogen stream 125 is sent to a power-recovery turbine 190 to generate power and reduce the pressure of the second hydrogen stream 125. The pressure and temperature of the second hydrogen stream 125 are controlled so that the hydrogen remains in the gas phase as it exits from the power-recovery turbine 190. As shown, control of the flowrate of second hydrogen stream 125 can be performed by power-recovery turbine 190, the control valves 220, 225, 230, 235, or both. The flowrate of the hydrogen gas can be measured and controlled by varying the speed or shaft torque of the power-recovery turbine 190.

The reduced pressure hydrogen stream 195 from the power-recovery turbine 190 is divided into four parts, hydrogen quench streams 200, 205, 210, 215. Each of the hydrogen quench streams 200, 205, 210, 215 has an associated control valve 220, 225, 230, 235 which can be used to control the flow of hydrogen entering the hydroprocessing bed in addition to the power-recovery turbine 190, or instead of it.

As shown, hydroprocessing reaction zone 155 has five hydroprocessing beds 160, 165, 170, 175, and 180. Heated feed stream 150, which contains hydrogen and hydrocarbon feed to be hydroprocessed, enters the first hydroprocessing bed 160 where it undergoes hydroprocessing. The effluent from the first hydroprocessing bed 160 is mixed with first hydrogen quench stream 200 to form first quenched hydroprocessed stream 240.

The first quenched hydroprocessed stream 240 is sent to the second hydroprocessing bed 165 where it undergoes further hydroprocessing. The effluent from the second hydroprocessing bed 165 is mixed with second hydrogen quench stream 205 to form second quenched hydroprocessed stream 245.

The second quenched hydroprocessed stream 245 is sent to the third hydroprocessing bed 170 where it undergoes further hydroprocessing. The effluent from the third hydroprocessing bed 170 is mixed with third hydrogen quench stream 210 to form third quenched hydroprocessed stream 250.

The third quenched hydroprocessed stream 250 is sent to the fourth hydroprocessing bed 175 where it undergoes further hydroprocessing. The effluent from the fourth hydroprocessing bed 175 is mixed with fourth hydrogen quench stream 215 to form fourth quenched hydroprocessed stream 255.

The fourth quenched hydroprocessed stream 255 is sent to the fifth hydroprocessing bed 180 where it undergoes further hydroprocessing. The effluent 260 from the fifth hydroprocessing bed 180 can be sent to various processing zones, such as heat exchange, vapor liquid flash separation, amine treating, distillation and recompression.

Figure 2:
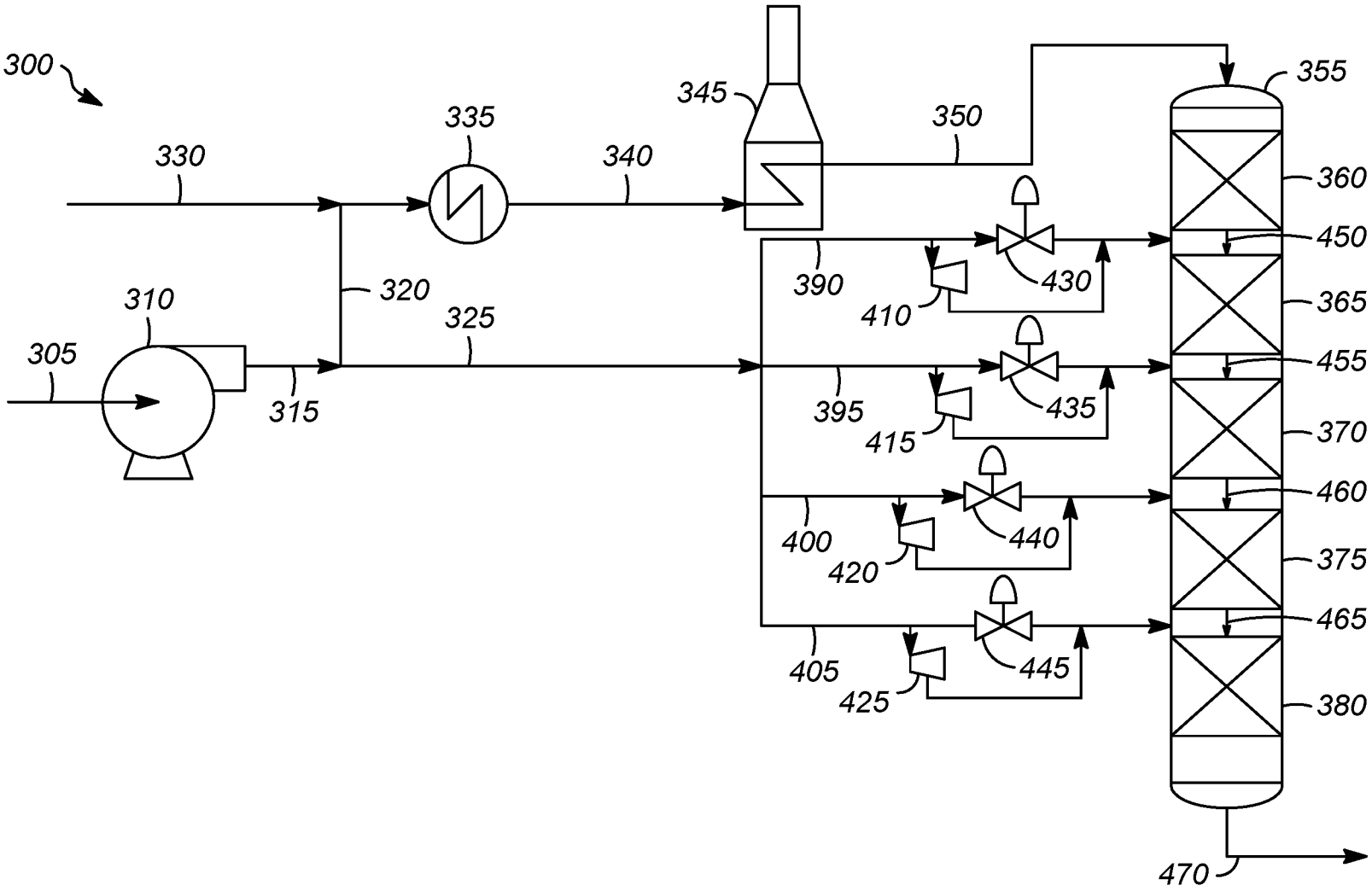
FIG. 2 is an illustration of another embodiment of the process of the present invention in a hydroprocessing unit.

FIG. 2 illustrates another embodiment of the process 300 in which the combination of power-recovery turbines in parallel with control valves is used to control the flowrate of the hydrogen gas. Hydrogen stream 305 is compressed in compressor 310. The compressed hydrogen stream 315 is split into first and second portions, hydrogen streams 320 and 325. First hydrogen stream 320 is mixed with the hydrocarbon feed stream 330 and sent through heat exchanger 335 to raise the temperature. The partially heated feed stream 340 is sent to fired heater 345 to raise the temperature of the feed stream 350 exiting the fired heater 345 to the desired inlet temperature for the hydroprocessing reaction zone 355.

Second hydrogen stream 325 is divided into four hydrogen quench streams 390, 395, 400, 405. Each of the hydrogen quench streams 390, 395, 400, 405 has a power-recovery turbine 410, 415, 420, 425 to generate power and control the flow of hydrogen entering the hydroprocessing bed as well as a control valve 430, 435, 440, 445 to control the flow of hydrogen entering the hydroprocessing bed or take on the full control of the hydrogen quench stream in case of failure of the power recovery turbine.

Hydrogen quench streams 390, 395, 400, 405 can be directed through either the power-recovery turbine 410, 415, 420, 425, the control valve 430, 435, 440, 445, or both. For example, a first fraction of first hydrogen quench stream 390 can be directed to the power-recovery turbine 410, and a second fraction can be directed to the control valve 430. The first fraction can vary from 0% to 100% and the second fraction can vary from 100% to 0%, or 10% to 100% for the first fraction and 90% to 0% for the second fraction, or 20% to 100% for the first fraction and 80% to 0% for the second fraction, or 30% to 100% for the first fraction and 70% to 0% for the second fraction, or 40% to 100% for the first fraction and 60% to 0% for the second fraction, or 50% to 100% for the first fraction and 50% to 0% for the second fraction, or 60% to 100% for the first fraction and 40% to 0% for the second fraction, or 70% to 100% for the first fraction and 30% to 0% for the second fraction, or 75% to 100% for the first fraction and 25% to 0% for the second fraction, or 80% to 100% for the first fraction and 20% to 0% for the second fraction, or 90% to 100% for the first fraction and 10% to 0% for the second fraction. The first fraction sent to the power-recovery turbine will typically be greater than the second fraction sent to the control valve. Thus, the flow of the hydrogen quench streams 390, 395, 400, 405 can be controlled by the power-recovery turbines 410, 415, 420, 425, the control valves 430, 435, 440, 445, or both, allowing excellent process flexibility. This arrangement allows for constant power turbines that do not control flow where the flow through the turbines is set at some level and the control is actually done with the parallel trim control valve. Alternatively, a flow controlling turbine could take all the flow and the parallel control valve just remain in standby mode to take over control in case of any turbine malfunction wherein the turbine needs to be bypassed. This arrangement is more likely to appear in redesigns of existing plants as the control valves are already in place and their addition involves little installation cost.

As shown, hydroprocessing reaction zone 355 has five hydroprocessing beds 360, 365, 370, 375, and 380. Feed stream 350, which contains hydrogen and hydrocarbon feed to be hydroprocessed, enters the first hydroprocessing bed 360 where it undergoes hydroprocessing. The effluent from the first hydroprocessing bed 360 is mixed with first hydrogen quench stream 390 to form first quenched hydroprocessed stream 450.

The first quenched hydroprocessed stream 450 is sent to the second hydroprocessing bed 365 where it undergoes further hydroprocessing. The effluent from the second hydroprocessing bed 365 is mixed with second hydrogen quench stream 395 to form second quenched hydroprocessed stream 455.

The second quenched hydroprocessed stream 455 is sent to the third hydroprocessing bed 370 where it undergoes further hydroprocessing. The effluent from the third hydroprocessing bed 370 is mixed with third hydrogen quench stream 400 to form third quenched hydroprocessed stream 460.

The third quenched hydroprocessed stream 460 is sent to the fourth hydroprocessing bed 375 where it undergoes further hydroprocessing. The effluent from the fourth hydroprocessing bed 375 is mixed with fourth hydrogen quench stream 405 to form fourth quenched hydroprocessed stream 465.

The fourth quenched hydroprocessed stream 465 is sent to the fifth hydroprocessing bed 380 where it undergoes further hydroprocessing. The effluent 470 from the fifth hydroprocessing bed 380 can be sent to various processing zones, as described above.

Figure 3:
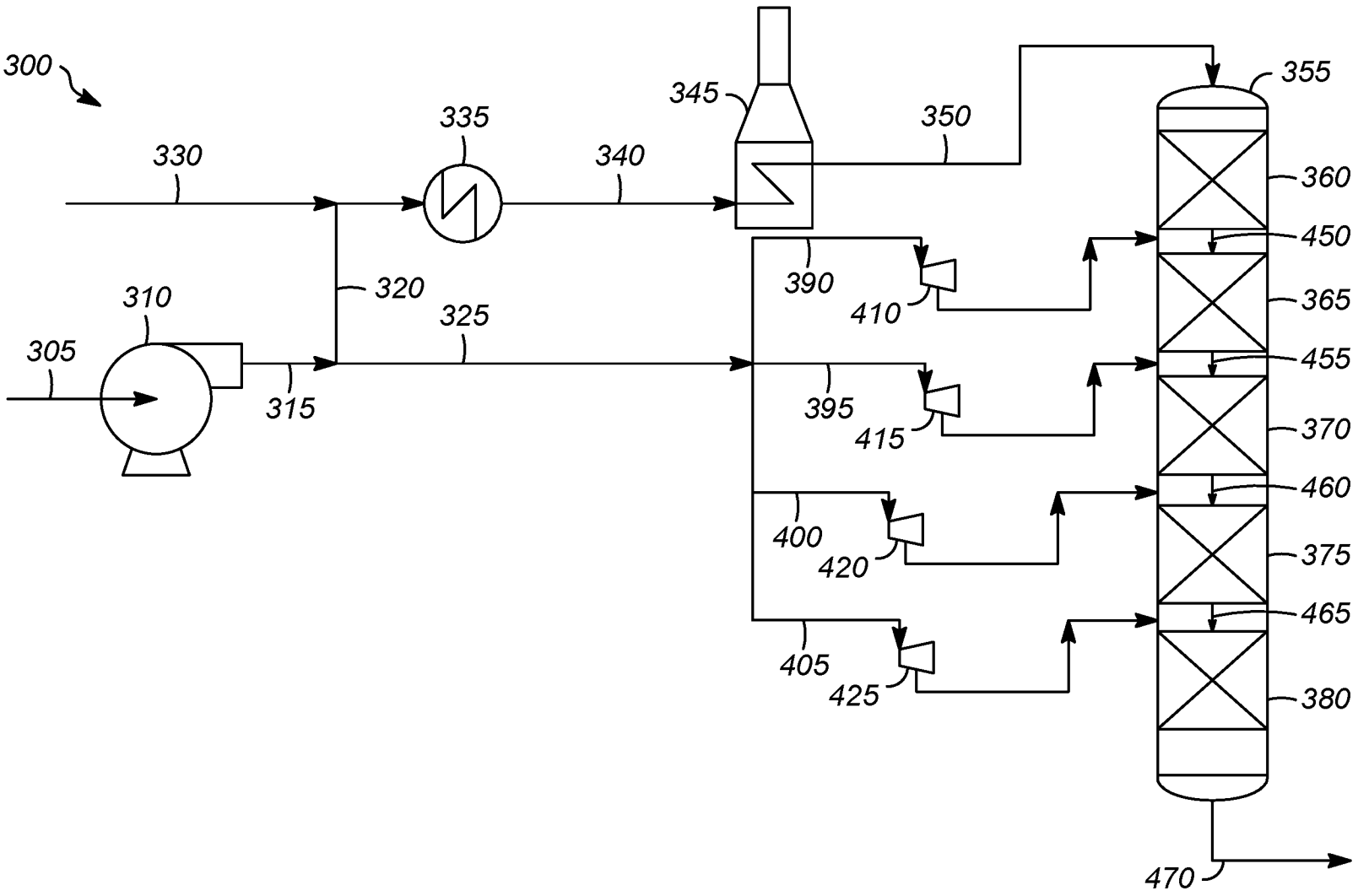
FIG. 3 is an illustration of another embodiment of the process of the present invention in a hydroprocessing unit.

The process of FIG. 3 is similar to that of FIG. 2, except that the control valves 430, 435, 440, 445 are not present. In this arrangement, the flowrate of second hydrogen stream 125 is controlled by power-recovery turbines 410, 415, 420, 425. This arrangement is more likely to appear in new plant designs than in redesigns of existing plants.

The devices and processes of the present invention are contemplated as being utilized in a hydroprocessing reaction zone. As is known, such hydroprocessing reaction zones utilize a process control system, typically on a computer in a control center.

The process control system described in connection with the embodiments disclosed herein may be implemented or performed on the computer with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or, the processor may be any conventional processor, controller, microcontroller, or state machine. A processor may also be a combination of computing devices, e.g., a combination of a DSP and a microprocessor, two or more microprocessors, or any other combination of the foregoing.

The steps of the processes associated with the process control system may be embodied in an algorithm contained directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is in communication with the processor such the processor reads information from, and writes information to, the storage medium. This includes the storage medium being integral to or with the processor. The processor and the storage medium may reside in an ASIC. The ASIC may reside in a user terminal. Alternatively, the processor and the storage medium may reside as discrete components in a user terminal. These devices are merely intended to be exemplary, non-limiting examples of a computer readable storage medium. The processor and storage medium or memory are also typically in communication with hardware (e.g., ports, interfaces, antennas, amplifiers, signal processors, etc.) that allow for wired or wireless communication between different components, computers processors, or the like, such as between the input channel, a processor of the control logic, the output channels within the control system and the operator station in the control center.

In communication relative to computers and processors refers to the ability to transmit and receive information or data. The transmission of the data or information can be a wireless transmission (for example by Wi-Fi or Bluetooth) or a wired transmission (for example using an Ethernet RJ45 cable or an USB cable). For a wireless transmission, a wireless transceiver (for example a Wi-Fi transceiver) is in communication with each processor or computer. The transmission can be performed automatically, at the request of the computers, in response to a request from a computer, or in other ways. Data can be pushed, pulled, fetched, etc., in any combination, or transmitted and received in any other manner.

According to the present invention, therefore, it is contemplated that the process control system receives information from the power-recovery turbine 190 or 410, 415, 420, 425 relative to an amount of electricity generated by the power-recovery turbine 190 or 410, 415, 420, 425. It is contemplated that the power-recovery turbine 190 or 410, 415, 420, 425 determines (via the processor) the amount of electricity it has generated. Alternatively, the process control system receiving the information determines the amount of electricity that has been generated by the power-recovery turbine 190 or 410, 415, 420, 425. In either configuration, the amount of the electricity generated by the power-recovery turbine 190 or 410, 415, 420, 425 is displayed on at least one display screen associated with the computer in the control center. If the hydroprocessing reaction zone comprises a plurality of power-recovery turbines 410, 415, 420, 425, it is further contemplated that the process control system receives information associated with the amount of electricity generated by each of the power-recovery turbines 410, 415, 420, 425. The process control system determines a total electrical power generated based upon the information associated with the each of the power-recovery turbines 410, 415, 420, 425 and displays that the total electrical power generated on the display screen. The total electrical power generated may be displayed instead of, or in conjunction with, the amount of electrical power generated by the individual power-recovery turbines 190 or 410, 415, 420, 425.

As discussed above, the electrical energy recovered by the power-recovery turbines 190 or 410, 415, 420, 425 is often a result of removing energy from the streams that was added to the streams in the hydroprocessing reaction zone. Thus, it is contemplated that the processes according to the present invention provide for the various processing conditions associated with the processing reaction zone to be adjusted into order to lower the energy added to the steam(s). The hydrogen leaving the hydrogen compression section is compressed to a pressure so that the flow can be controlled to the higher pressure reactor combined feed heat exchangers and the feed furnace and first reaction bed in addition to each hydrogen stream between beds. The turbine power recoveries between beds may signal on opportunity to decrease the compressor outlet pressure while still maintaining the flow control as the energy recovered from the power-recovery turbines is set above the experientially determined economically optimum amount. In this way the turbines can signal an opportunity to save even more energy than recovering it in the turbine but instead never add a portion of that energy to the system in the first place.

It is contemplated that the process control system receives information associated with the throughput of the hydroprocessing reaction zone, and determines a target electrical power generated value for the turbine(s) since the electricity represents energy that is typically added to the overall hydroprocessing reaction zone. The determination of the target electrical power generated value may be done when the electricity is at or near a predetermined level. In other words, if the amount of electricity produced meets or exceeds a predetermined level, the process control system can determine one or more processing conditions to adjust and lower the amount of electricity generated until it reaches the target electrical power generated value.

Thus, the process control system will analyze one or more changes to the various processing conditions associated with the hydroprocessing reaction zone to lower the amount of energy recovered by the power-recovery turbines of the hydroprocessing reaction zone. Preferably, the processing conditions are adjusted without adjusting the throughput of the hydro processing zone. This allows for the hydroprocessing reaction zone to have the same throughput, but with a lower operating cost associated with the same throughput. The process control software may calculate and display the difference between the target electrical power generated value and the total electrical power generated on the display screen.

For example, the process control software may recognize that the total electrical power generated exceeds a predetermined level. Accordingly, the process control software may determine the target electrical power generated value. Based upon other data and information received from other sensors and data collection devices typically associated with the hydroprocessing reaction zone, the process control software may determine that the amount of fuel consumed in the heater can be lowered. While maintaining the throughput of the hydroprocessing reaction zone, the amount of fuel consumed in the heater is lowered. While this may lower the electricity generated by the power-recovery turbine, the lower fuel consumption provides a lower operating cost for the same throughput. It may also determine that reduced pressure or flow is optimal for the throughput of the hydrogen compressors. It this way steam or electricity to the compressor driver could be decreased.

Thus, not only does the present invention convert energy that is typically lost into a form that is used elsewhere in the hydroprocessing reaction zone, the hydroprocessing reaction zones are provided with opportunities to lower the energy input associated with the overall hydroprocessing reaction zone and increase profits by utilizing more energy efficient processes.

It should be appreciated and understood by those of ordinary skill in the art that various other components, such as valves, pumps, filters, coolers, etc., are not shown in the drawings as it is believed that the specifics of same are well within the knowledge of those of ordinary skill in the art and a description of same is not necessary for practicing or understanding the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Specific Embodiments

While the following is described in conjunction with specific embodiments, it will be understood that this description is intended to illustrate and not limit the scope of the preceding description and the appended claims.

A first embodiment of the invention is a process for controlling a flowrate of and recovering energy from a gas stream in a processing unit comprising directing at least a portion of the gas stream through one or more variable-resistance power-recovery turbines to control the flowrate of the gas stream and generate electric power therefrom; and controlling a pressure and temperature of the gas stream so that the gas exiting the power-recovery turbine remains in a gas phase. An embodiment of the invention is one, any or all of prior embodiments in this paragraph up through the first embodiment in this paragraph wherein the flowrate is measured or controlled or both by varying one or more of the speed or shaft torque of the one or more power-recovery turbines. An embodiment of the invention is one, any or all of prior embodiments in this paragraph up through the first embodiment in this paragraph wherein the flowrate varies by less than about 10%. An embodiment of the invention is one, any or all of prior embodiments in this paragraph up through the first embodiment in this paragraph wherein the power-recovery turbine replaces a control valve in the process. An embodiment of the invention is one, any or all of prior embodiments in this paragraph up through the first embodiment in this paragraph wherein the power-recovery turbine is used in conjunction with a control valve, and further comprising directing a second portion of the gas stream through the control valve. An embodiment of the invention is one, any or all of prior embodiments in this paragraph up through the first embodiment in this paragraph wherein the power recovered is displayed on at least one display screen. An embodiment of the invention is one, any or all of prior embodiments in this paragraph up through the first embodiment in this paragraph wherein the portion of the gas stream directed through the power-recovery turbine is greater than the second portion of the gas stream directed though the control valve. An embodiment of the invention is one, any or all of prior embodiments in this paragraph up through the first embodiment in this paragraph further comprising receiving information from a plurality of pressure reducing devices, the plurality of pressure reducing devices comprising the one or more power-recovery turbines a control valve, or both; determining a power loss value or a power generated value for each of the pressure reducing devices; determining a total power loss value or a total power generated value based upon the power loss values or the power generated values from each of the pressure reducing devices; and, displaying the total power loss value or the total power generated value on at least one display screen. An embodiment of the invention is one, any or all of prior embodiments in this paragraph up through the first embodiment in this paragraph further comprising adjusting at least one process parameter in the processing unit based upon the total power loss value or the total power generated value. An embodiment of the invention is one, any or all of prior embodiments in this paragraph up through the first embodiment in this paragraph further comprising after the at least one process parameter has been adjusted, determining an updated power loss value or an updated power generated value for each of the pressure reducing devices; determining an updated total power loss value or an updated total power generated value for the processing unit based upon the updated power loss values or the updated power generated values from each of the pressure reducing devices; and, displaying the updated total power loss value or the updated total power generated value on the at least one display screen. An embodiment of the invention is one, any or all of prior embodiments in this paragraph up through the first embodiment in this paragraph further comprising receiving information associated with conditions outside of the processing unit, wherein the total power loss value target or the total power generated value target is determined based in part upon the information associated with conditions outside of the processing unit. An embodiment of the invention is one, any or all of prior embodiments in this paragraph up through the first embodiment in this paragraph further comprising receiving information associated with a throughput of the processing unit, wherein the total power loss value or the total power generated value is determined based in part upon the information associated with the throughput of the processing unit. An embodiment of the invention is one, any or all of prior embodiments in this paragraph up through the first embodiment in this paragraph further comprising maintaining the throughput of the processing unit while adjusting at least one process parameter of the processing unit based upon the total power loss value or the total power generated value.

A second embodiment of the invention is a process for controlling a flowrate of and recovering energy from a gas stream in a processing unit comprising directing at least a portion of the gas stream through one or more variable-resistance power-recovery turbines to control the flowrate of the gas stream and generate electric power therefrom; controlling a pressure and temperature of the gas stream so that the gas exiting the power-recovery turbine remains in the gas phase; and measuring the flowrate or controlling the flowrate or both by varying one or more of the speed or shaft torque of the one or more power-recovery turbines. An embodiment of the invention is one, any or all of prior embodiments in this paragraph up through the second embodiment in this paragraph wherein the flowrate varies by less than about 10%. An embodiment of the invention is one, any or all of prior embodiments in this paragraph up through the second embodiment in this paragraph wherein the power-recovery turbine replaces a control valve in the process. An embodiment of the invention is one, any or all of prior embodiments in this paragraph up through the second embodiment in this paragraph wherein the power-recovery turbine is used in conjunction with a control valve, and further comprising directing a second portion of the gas through the control valve. An embodiment of the invention is one, any or all of prior embodiments in this paragraph up through the second embodiment in this paragraph wherein the portion of the gas stream directed through the power-recovery turbine is greater than the second portion of the gas stream directed though the control valve. An embodiment of the invention is one, any or all of prior embodiments in this paragraph up through the second embodiment in this paragraph further comprising receiving information from a plurality of pressure reducing devices, the plurality of pressure reducing devices comprising one or more power-recovery turbines, a control valve, or both; determining a power loss value or a power generated value for each of the pressure reducing devices; determining a total power loss value or a total power generated value based upon the power loss values or the power generated values from each of the pressure reducing devices; and, displaying the total power loss value or the total power generated value on at least one display screen.

A third embodiment of the invention is a process for controlling a flowrate of and recovering energy from a gas stream in a processing unit comprising directing at least a portion of the gas stream through one or more variable-resistance power-recovery turbines to control the flowrate of the gas stream and generate electric power therefrom; and controlling a pressure and temperature of the gas stream so that the gas exiting the power-recovery turbine remains in the gas phase. receiving information from a plurality of pressure reducing devices, the plurality of pressure reducing devices comprising one or more power-recovery turbines, a control valve, or both; determining a power loss value or a power generated value for each of the pressure reducing devices; determining a total power loss value or a total power generated value based upon the power loss values or the power generated values from each of the pressure reducing devices; and, displaying the total power loss value or the total power generated value on at least one display screen. An embodiment of the invention is one, any or all of prior embodiments in this paragraph up through the third embodiment in this paragraph wherein the flowrate is measured or controlled or both by varying one or more of the speed or shaft torque of the one or more power-recovery turbines.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A process for controlling a flowrate of and recovering energy from a gas stream in a processing unit comprising:

directing at least a portion of the gas stream through one or more variable-resistance power-recovery turbine to control the flowrate of the gas stream and generate electric power therefrom;

controlling a pressure and temperature of the gas stream through the one or more power-recovery turbine so that the gas exiting the one or more power-recovery turbine remains in a gas phase; and measuring the flowrate and controlling the pressure and temperature of the gas stream through the one or more power-recovery turbine based on a measured flowrate using turbine revolutions per minute of the one or more power-recovery turbine and a load on a circuit.

2. The process of claim 1 further comprising controlling the flowrate by varying one or more of the speed or shaft torque of the one or more power-recovery turbine.

3. The process of claim 1 further comprising replacing a control valve with the one or more power-recovery turbine before directing the at least the portion of the gas stream through the one or more power-recovery turbine.

4. The process of claim 1 wherein the one or more power-recovery turbine is used in conjunction with a control valve, and further comprising directing a second portion of the gas stream through the control valve.

5. The process of claim 4 wherein the portion of the gas stream directed through the one or more power-recovery turbine is greater than the second portion of the gas stream directed though the control valve.

6. The process of claim 1 wherein the power recovered is displayed on at least one display screen.

7. The process of claim 1 further comprising:

receiving information from a plurality of pressure reducing devices, the plurality of pressure reducing devices comprising: the one or more power-recovery turbine; a control valve; or, both;

determining a power loss value or a power generated value for each of the pressure reducing devices;

determining a total power loss value or a total power generated value based upon the power loss values or the power generated values from each of the pressure reducing devices; and, displaying the total power loss value or the total power generated value on at least one display screen.

8. The process of claim 7 further comprising adjusting at least one process parameter in the processing unit based upon the total power loss value or the total power generated value.

9. The process of claim 8 further comprising:

after the at least one process parameter has been adjusted, determining an updated power loss value or an updated power generated value for each of the pressure reducing devices;

determining an updated total power loss value or an updated total power generated value for the processing unit based upon the updated power loss values or the updated power generated values from each of the pressure reducing devices; and, displaying the updated total power loss value or the updated total power generated value on the at least one display screen.

10. The process of claim 7 further comprising:

receiving information associated with conditions outside of the processing unit, wherein a total power loss value target or a total power generated value target is determined based in part upon the information associated with conditions outside of the processing unit.

11. The process of claim 7 further comprising:

receiving information associated with a throughput of the processing unit, wherein the total power loss value or the total power generated value is determined based in part upon the information associated with the throughput of the processing unit.

12. The process of claim 11 further comprising:

maintaining the throughput of the processing unit while adjusting at least one process parameter of the processing unit based upon the total power loss value or the total power generated value.

13. A process for controlling a flowrate of and recovering energy from a gas stream in a processing unit comprising:

directing at least a portion of the gas stream through one or more variable-resistance power-recovery turbine having variable position inlet guide vanes to control the flowrate of the gas stream and generate electric power therefrom;

controlling a pressure and temperature of the gas stream through the one or more power-recovery turbine so that the gas exiting the one or more power-recovery turbine remains in the gas phase; and measuring the flowrate and controlling the pressure and temperature of the gas stream through the one or more power-recovery turbine based on a measured flowrate using a position of the variable position inlet guide vanes, turbine revolutions per minute of the one or more power-recovery turbine, and power output;

wherein the one or more power-recovery turbine replaces a control valve in the process.

14. The process of claim 13 further comprising:

receiving information from a plurality of pressure reducing devices, the plurality of pressure reducing devices comprising: the one or more power-recovery turbine; a control valve; or, both;

determining a power loss value or a power generated value for each of the pressure reducing devices;

determining a total power loss value or a total power generated value based upon the power loss values or the power generated values from each of the pressure reducing devices; and, displaying the total power loss value or the total power generated value on at least one display screen.

15. A process for controlling a flowrate of and recovering energy from a gas stream in a processing unit comprising:

directing at least a portion of the gas stream through one or more variable-resistance power-recovery turbine to control the flowrate of the gas stream and generate electric power therefrom;

controlling a pressure and temperature of the gas stream through the one or more power-recovery turbine so that the gas exiting the one or more power-recovery turbine remains in the gas phase;

measuring the flowrate and controlling the pressure and temperature of the gas stream through the one or more power-recovery turbine based on a measured flowrate using turbine revolutions per minute of the one or more power-recovery turbine and a load on a circuit;

receiving information from a plurality of pressure reducing devices, the plurality of pressure reducing devices comprising: the one or more power-recovery turbine, a control valve, or, both;

determining a power loss value or a power generated value for each of the pressure reducing devices;

determining a total power loss value or a total power generated value based upon the power loss values or the power generated values from each of the pressure reducing devices; and, displaying the total power loss value or the total power generated value on at least one display screen.

16. The process of claim 15 further comprising replacing a control valve with the one or more power-recovery turbine before directing the at least the portion of the gas stream through the one or more power-recovery turbine.

17. The process of claim 15 wherein the one or more power-recovery turbine is used in conjunction with a control valve, and further comprising directing a second portion of the gas through the control valve.

18. The process of claim 17 wherein the portion of the gas stream directed through the one or more power-recovery turbine is greater than the second portion of the gas stream directed though the control valve.

19. The process of claim 15 further comprising controlling the flowrate by varying one or more of the speed or shaft torque of the one or more power-recovery turbine.

* * * * *